US005946886A

United States Patent [19]

Bealer

[11] Patent Number: 5,946,886

[45] Date of Patent: Sep. 7, 1999

[54] SYSTEMS FOR TRANSFERRING AND REPOSITIONING CONTAINER LIDS

[75] Inventor: Kenneth H. Bealer, Wilmington, N.C.

[73] Assignee: Sweetheart Cup, Owings Mills, Md.

[21] Appl. No.: 08/932,912

[22] Filed: Sep. 17, 1997

[51] Int. Cl.[6] ..... B06B 7/28

[52] U.S. Cl. ..... 53/307; 53/287

[58] Field of Search ..... 53/307, 287, 306

[56] References Cited

U.S. PATENT DOCUMENTS

| | | | |
|---|---|---|---|
| 935,505 | 9/1909 | Heybach | 53/307 X |
| 1,864,008 | 6/1932 | Wright et al. | 53/307 X |
| 1,905,615 | 4/1933 | Wright et al. | 53/307 X |
| 1,919,060 | 7/1933 | Harder | 53/307 X |
| 2,638,258 | 5/1953 | Bowen | 53/307 X |
| 2,972,216 | 2/1961 | Schmidt | 53/307 X |
| 3,487,622 | 1/1970 | Mueller | 53/307 X |
| 3,509,682 | 5/1970 | Logemann | 53/307 X |
| 3,545,173 | 12/1970 | Christine et al. | 53/307 |
| 3,777,504 | 12/1973 | Marchi . | |
| 4,188,768 | 2/1980 | Getman . | |
| 4,192,415 | 3/1980 | Krener et al. . | |
| 4,224,895 | 9/1980 | Launay . | |
| 4,297,828 | 11/1981 | Krieger et al. | 53/307 X |
| 4,498,273 | 2/1985 | Colamussi . | |
| 4,555,892 | 12/1985 | Dijkman . | |
| 4,643,905 | 2/1987 | Getman . | |
| 4,686,813 | 8/1987 | Sawada . | |
| 4,694,637 | 9/1987 | Bech et al. . | |
| 4,703,607 | 11/1987 | Propperd et al. | 53/307 |
| 4,731,977 | 3/1988 | Maekawa . | |
| 4,750,312 | 6/1988 | De Vaujany | 53/307 |
| 4,799,351 | 1/1989 | Blanda . | |
| 4,866,907 | 9/1989 | Iuchi et al. | 53/307 X |
| 4,899,866 | 2/1990 | Colamussi . | |
| 4,901,502 | 2/1990 | Colamussi . | |
| 5,064,666 | 11/1991 | Vos . | |
| 5,102,672 | 4/1992 | Vos . | |
| 5,228,267 | 7/1993 | Blankenship et al. . | |
| 5,257,493 | 11/1993 | Cocchi et al. . | |
| 5,298,273 | 3/1994 | Ito . | |
| 5,379,569 | 1/1995 | Mueller . | |

FOREIGN PATENT DOCUMENTS

| | | | |
|---|---|---|---|
| 421543 | 4/1991 | European Pat. Off. | 53/307 |
| 702704 | 10/1951 | United Kingdom | 53/307 |

*Primary Examiner*—Daniel B. Moon
*Attorney, Agent, or Firm*—Nixon & Vanderhye P.C.

[57] ABSTRACT

Systems are provided whereby a container lid may be transferred from a supply stack and be repositioned relative to an awaiting container using a substantially constant-rate reciprocal drive. The systems most preferably include a reciprocally displaceable mounting block carrying a rotatable transfer arm. The transfer arm, in turn, carries a pick-up head so that the pick-up head is rotatable with the transfer arm. The pick-up head rotation is controlled by a rack-and-pinion mechanical control assembly having a pair of opposed compression springs, a gear rack mounted between the opposed compression springs, and a pinion gear meshed with the gear rack and connected to the transfer arm. The gear rack includes a control rod which is slidably coupled to the mounting block during reciprocal displacements thereof. However, the mounting block will come into contact with travel limit stops provided at each end of the control rod so that during the final travel of the mounting block during its reciprocal movement, the mounting block and gear block will be locked as a unit and be displaced against the bias force of one of the springs.

5 Claims, 10 Drawing Sheets

SYSTEMS FOR TRANSFERRING AND REPOSITIONING CONTAINER LIDS

FIELD OF THE INVENTION

The present invention relates generally to the field of automated packaging systems. More specifically, the present invention relates to automated packaging systems whereby container lids may be transferred from an available stand-by supply stack and repositioned on an associated container body (e.g., so as to close the container and its contents, if any).

BACKGROUND AND SUMMARY OF THE INVENTION

Containers employed in the food and beverage industry will typically include a removable lid to allow access to the container's contents. Thus, during typical automated container filling operations, food or beverage items are first placed into an awaiting empty container, and thereafter conveyed to a so-called "lidding" station where lids are removably secured to the container.

One specific example of conventional lidding stations is in connection with the automated production of frozen dessert cones, such as that described in U.S. Pat. No. 4,188,768 to Getman (the entire content of which is expressly incorporated hereinto by reference). In general, frozen dessert cones are produced by intermittently advancing a nested cone assembly (comprised of the frustroconically shaped edible prebaked cone and its conformably shaped paper overwrap) through a succession of stations. Thus, for example, an atomized spray of chocolate (or other flavored syrup) may be sprayed on the interior surfaces of the edible cone prior to the cone being filled with a freezable dairy product. Thereafter, a topping of chocolate (or other flavored syrup) and nuts may be applied immediately upstream of a lidding station. The finished product is then ejected from its conveyance track and subjected to freezing conditions.

The lidding station of the Getman '768 patent essentially has rotatable arms which are rotatable into engagement with a lowermost closure lid stacked in a magazine assembly aligned thereabove. In such a manner, the closure lid may be captured at the end of the rotatable arms by means of vacuum. However, when it is desired to place the closure lid onto the awaiting filled cones, separate means must be actuated by a timing mechanism in order to drive the arms downwardly to engage the closure lids held by the arms with the cone rims. (See column 6, lines 36–44 of the Getman '768 patent).

Although the lidding station disclosed in the Getman '768 patent is sufficient for its intended purpose, some improvements would be desirable. For example, it would especially be desirable if the rotational and upward/downward movements of the lid pick-up arms could be provided by a single, constant-rate reciprocal drive mechanism so that the relatively complex and separate timing/drive systems proposed by Getman '768 patent could be eliminated. It is towards providing such lidding station improvements that the present invention is directed.

Broadly, the present invention is directed toward systems whereby a container lid may be transferred from a supply stack and be repositioned relative to an awaiting container using a substantially constant-rate reciprocal drive. In such a manner, separate timing and/or drive assemblies required in the prior art to rotate and to vertically lower/raise the lid pick-up arms may be eliminated.

More specifically, the present invention includes a reciprocally displaceable mounting block carrying a rotatable transfer arm. The transfer arm, in turn, carries a pick-up head so that the pick-up head is rotatable with the transfer arm. The pick-up head rotation is controlled by a rack-and-pinion mechanical control assembly having a pair of opposed compression springs, a gear rack mounted between the opposed compression springs, and a pinion gear meshed with the gear rack and connected to the transfer arm. The gear rack includes a control rod which is slidably coupled to the mounting block during reciprocal displacements thereof. However, the mounting block will come into contact with travel limit stops provided at each end of the control rod so that during the final travel of the mounting block during its reciprocal movement, the mounting block and gear block will be locked as a unit and be displaced against the bias force of one of the springs. In such a manner, therefore, mechanical timing and control of the pick-up head rotation and its displacement relative to the stack of container lids and the awaiting container is provided.

These, and other aspects and advantages of the present invention will become more clear from the following detailed description of the preferred exemplary embodiments thereof.

BRIEF DESCRIPTION OF THE ACCOMPANYING DRAWINGS

Reference will hereinafter be made to the accompanying drawings wherein like reference numerals throughout the various FIGURES denote like structure elements, and wherein.

DETAILED DESCRIPTION OF THE INVENTION

Figure 1:
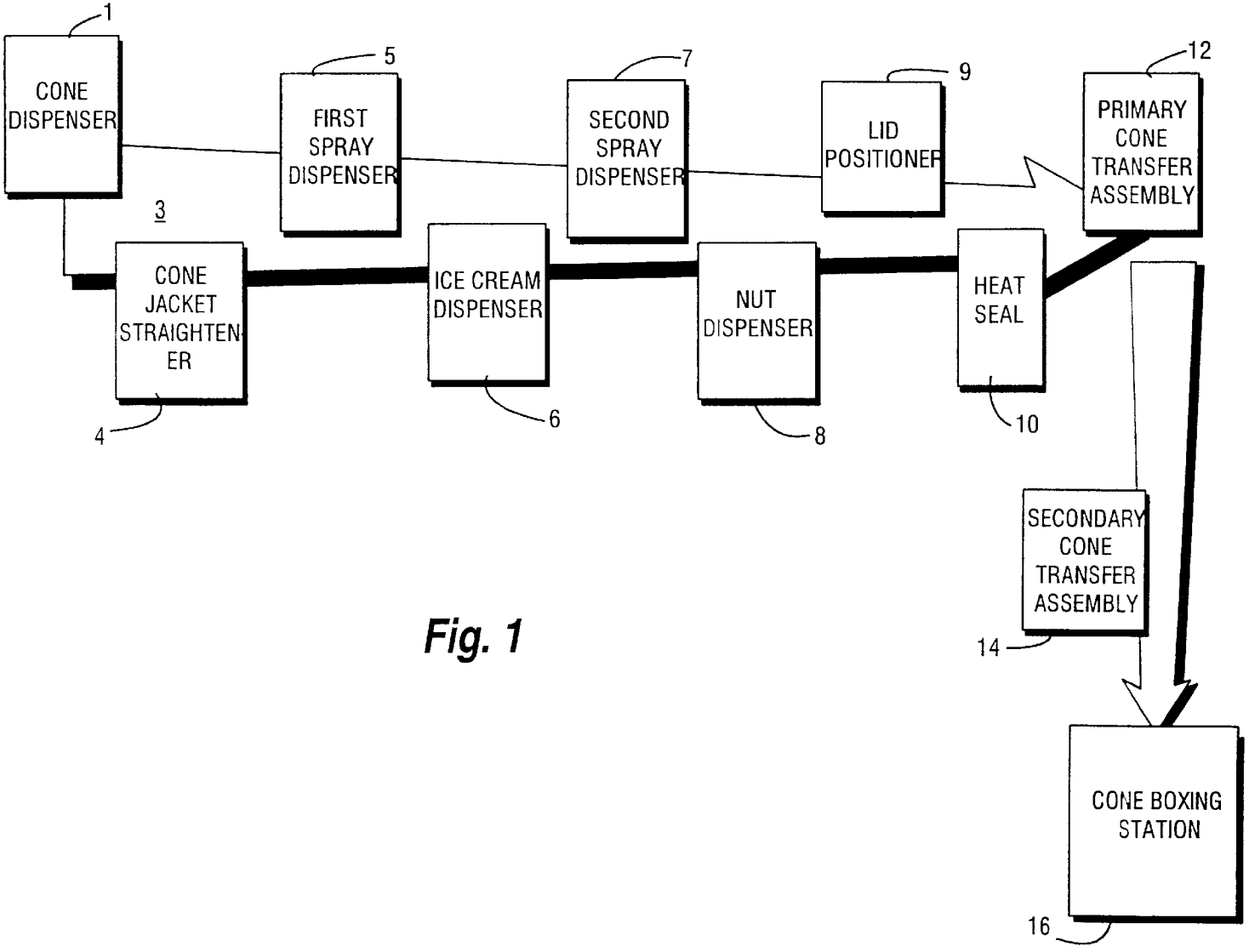
FIG. 1 is a schematic box diagram showing the various stations employed to automatically fill package frozen dessert cones which includes a lid transfer and positioning system in accordance with the present invention.

Accompanying FIG. 1 depicts schematically the various operations employed in the present invention. Specifically, frozen confection cones may be produced using any number (or all) of the production stations disclosed more fully in the above-cited U.S. Pat. No. 4,188,768 to Getman. That is, the system 1 according to the present invention may include a cone dispensing station 2 whereby nested edible cones and their conformably shaped paper overwraps may be dispensed onto a conveyor 3. Most preferably, the cone dispenser 1 is in accordance with U.S. patent application Ser. No. 08/931,939 filed on Sep. 17, 1997, (the entire content of which is expressly incorporated hereinto by reference). The cones may thereafter be brought into the cone jacket straightener 4 which ensures that the cones and jackets are properly positioned on the conveyor 3.

The cones may then be brought sequentially through a first spray dispenser 5, an ice cream dispenser 6 and a second spray dispenser 7. The first spray dispenser 5 dispenses a spray of flavored syrup (e.g., chocolate) so as to coat the interior surface of the cone into which the ice cream is to be dispensed by the dispenser 6. The second spray dispenser 7 will thereafter dispense a flavored syrup topping spray onto the ice cream in the cone. Most preferably, the syrup dispensers 6 and/or 7 are in accordance with U.S. patent application Ser. No. 08/929,368 filed on Sep. 17, 1997 (now U.S. Pat. No. 5,865,895) (the entire content of which is expressly incorporated hereinto by reference). A quantity of nuts may thereafter be applied to the top of the ice cream in the cone by the nut dispenser 8. A paper lid is positioned over the top of the ice cream filled cone by the lid positioner and is heat-sealed to the outer paper wrapper by means of the heat seal unit 10.

Thereafter, the finished cones are transferred by the primary cone transfer station 12 so that multiple pairs of such cones are reoriented from their machine aligned position to a head-to-tail cross-machine position as briefly noted above. The reoriented array of cones may then be brought to the secondary cone transfer assembly 14 where the array is transferred as a unit to a cone boxing station 16. The cone array is thus placed by the secondary transfer station 14 into a suitably configured container at the boxing station 16 conforming to the external shape of the cone array. The boxed cones may then be shipped to retail customers. Most preferably, the primary and secondary cone transfer assemblies are in accordance with U.S. application Ser. No. 08/889,878 filed Jul. 8, 1997 (Atty. Dkt. No. 956-173), the entire content of which is expressly incorporated hereinto by reference.

Figure 2:
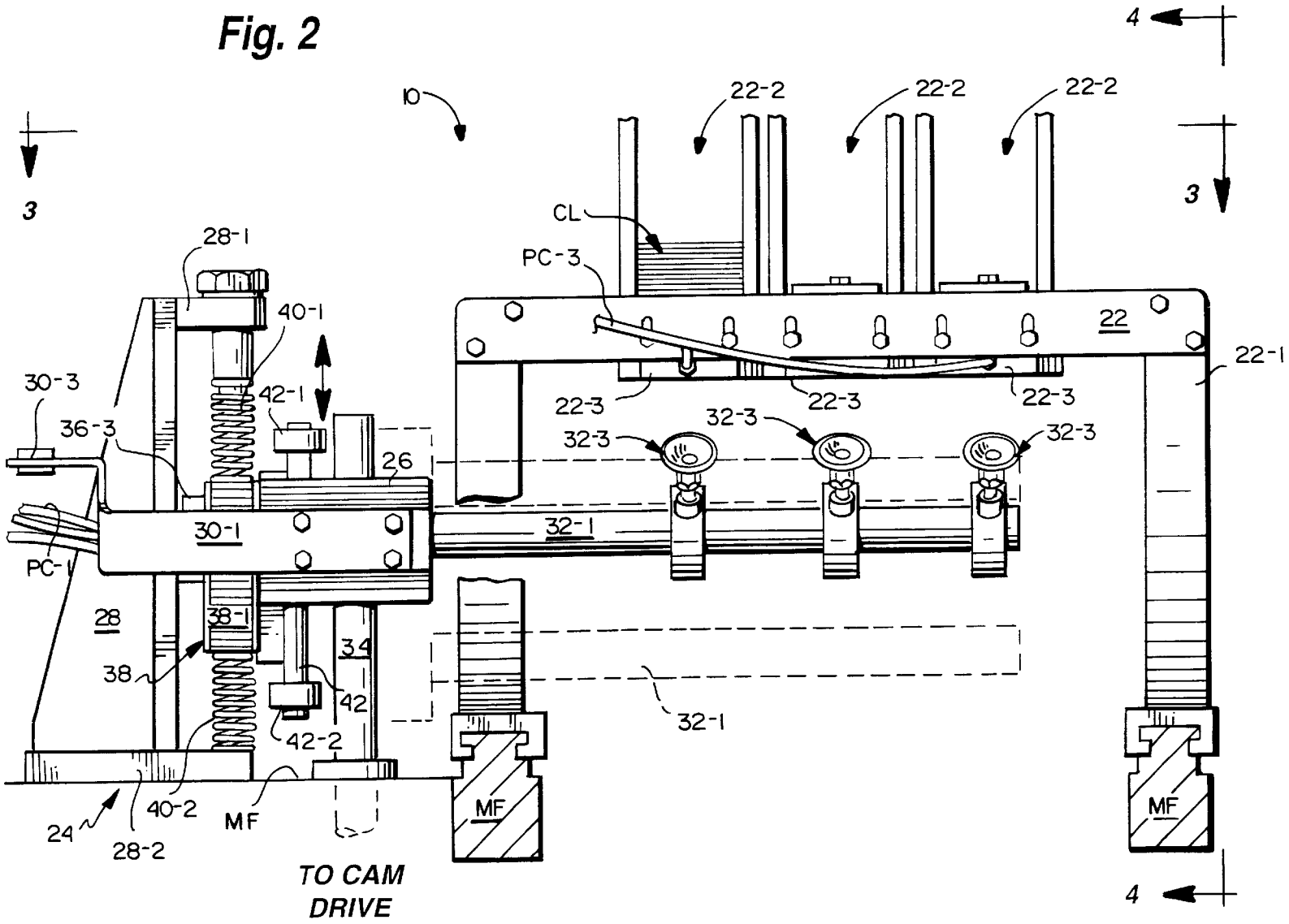
FIG. 2 is a side elevational view of a preferred lid transfer and positioning system in accordance with the present invention.
Figure 3:
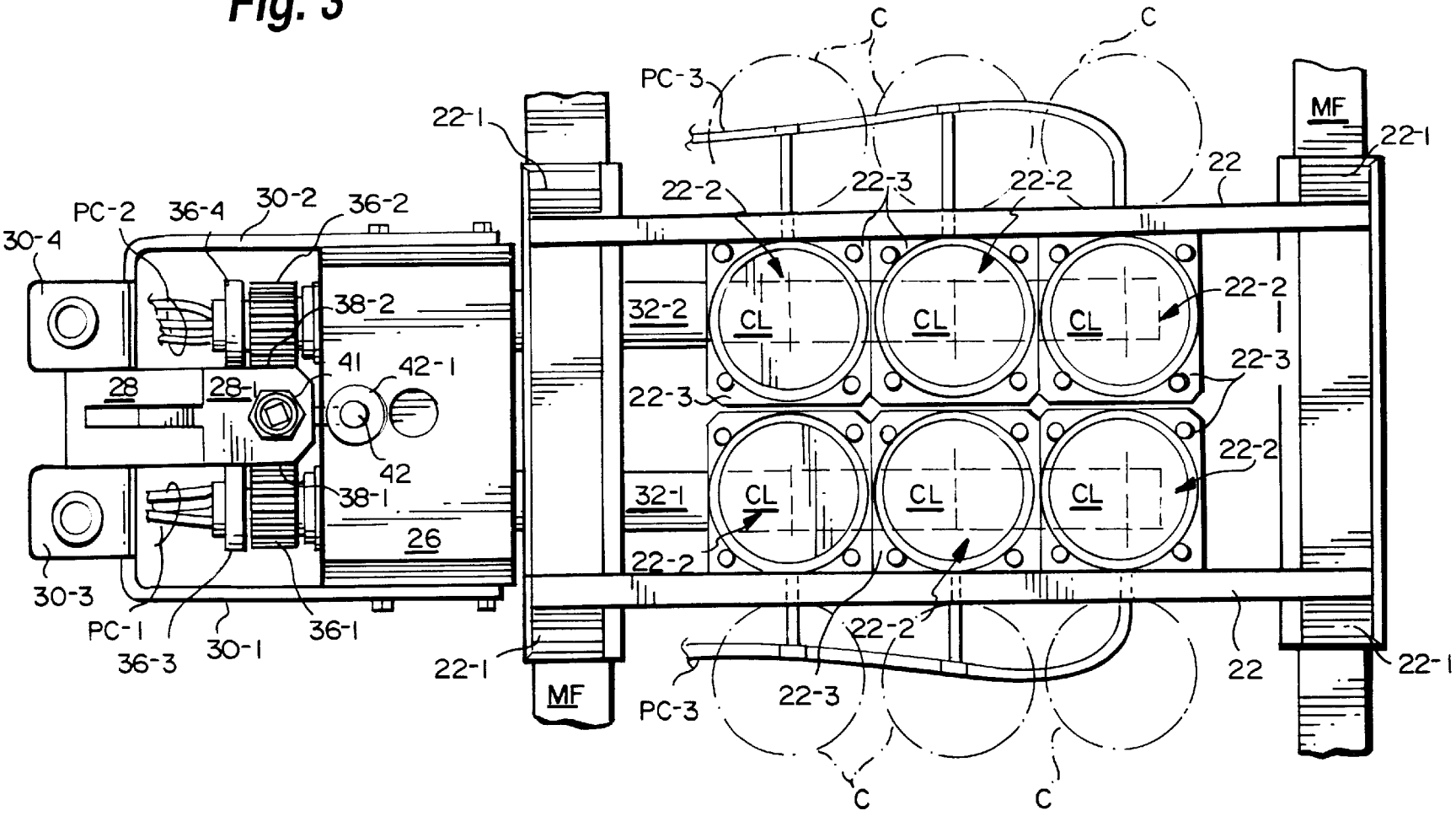
FIG. 3 is a top plan view of the lid transfer and positioning system depicted in FIG. 2 as taken along lines 3—3 therein.
Figure 4:
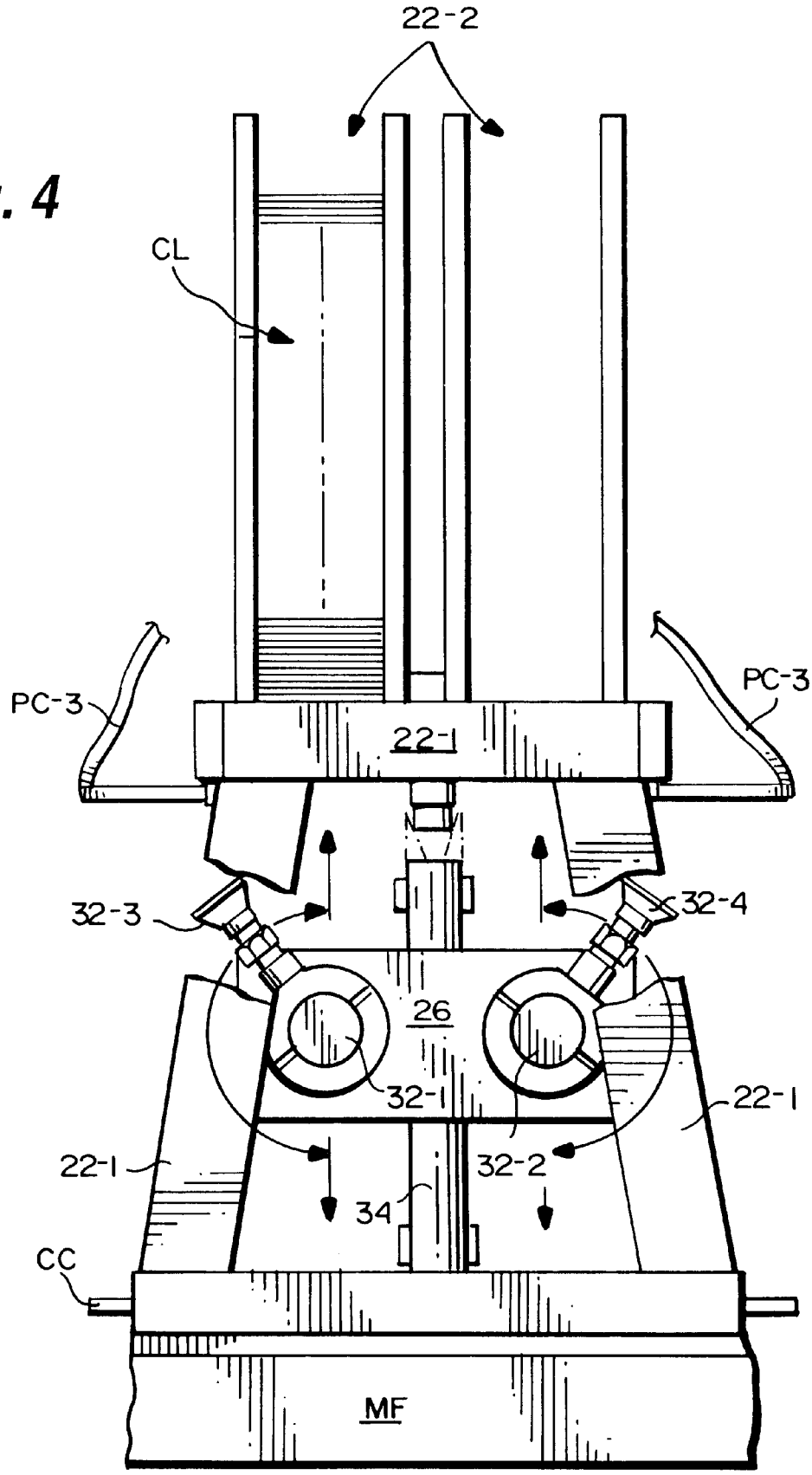
FIG. 4 is an end elevational view of the lid transfer and positioning system depicted in FIG. 2 as taken along lines 4—4 therein.

Accompanying FIGS. 2–4 show in greater detail the structural components of a particularly preferred lid transfer and reorientation system 20 according to the present invention (hereinafter more simply referred to as "lidding system 20") that may usefully be employed in the lid positioner station 9 of FIG. 1.

In this regard, the lidding system 20 includes a lid supply assembly 22 and a lid transfer assembly 24. The lid supply assembly includes a bridge support structure 22-1 which spans a container conveyor CC (see FIG. 4) carrying frozen dessert cones C (see FIGS. 3, 5E and 5F). The bridge support 22-1 thus supports a number of lid magazines 22-2 each of which is adapted to hold a vertical stack of container lids CL. The lid magazines are provided with a conventional lid release collar 22-3 at a bottom end thereof. In this regard, the lid release collars 22-3 include fixed-position detents (not shown) which support the stack of container lids CL. Pneumatic conduits PC-3 direct pressurized air to the collars 22-3 so as to provide air separation between the individual ones of container lids CL in the stack in a manner that will be explained in greater detail below.

The lid transfer assembly 24 includes a mounting block 26 which is slidably mounted to an upright support column 34. The mounting block 26 rotatably carries a pair of tubular transfer arms 32-1, 32-2 in a cantilever fashion so that the arms 32-1, 32-2 project forwardly over the container conveyor CC. The arms 32-1 and 32-2 are coupled to the block 26 so as to allow for rotational motion in clockwise and counterclockwise directions in response to reciprocal vertical movements of the mounting block 26 along column 34. The transfer arms are provided with respective pick-up heads 32-3, 32-4 which are coupled to a vacuum source via a respective one of the pneumatic conduits PC-1, PC-2. Rotation of the transfer arms 32-1, 32-2 will likewise responsively cause their respective pick-up heads 32-3, 32-4 to rotate and be vertically displaced in a manner to be described in greater detail below.

In this regard, the mounting block is rigidly fixed to a distal end of drive shaft 34 which is mounted for reciprocal movements to the machine frame MF. The opposite end of the drive shaft 34 is coupled operatively to a continuously rotatable cam element which synchronizes the continuous vertical movements of the system 10 with movements of a container conveyor CC carrying frozen desert cones C. Thus, the mounting block 26 is, in turn, driven continuously between its uppermost and lowermost extents as shown in dashed lines in FIG. 2.

Each of the transfer arms 32-1, 32-2 carries a pinion gear 36-1, 36-2 which is intermeshed with a respective gear rack 38-1, 38-2 associated with gear block 38. The pinion gears 36-1, 36-2 are fixed to the transfer arms 32-1, 32-2 and are rotatably attached to fixed-position flanges 36-3 and 36-4, respectively. Thus, as the mounting block 26 reciprocates vertically, the pinion gears 36-1, 36-2 are caused to rotate along the gear racks 38-1, 38-2, respectively, of the gear block 38 during a major extent of such vertical reciprocation. That is, the size of the pinion gears 36-1, 36-2 and the length of their respective gear racks 38-1, 38-2 are chosen so as to allow the pick-up heads 32-3, 32-4 to achieve a vertically upward and vertically downward orientation just prior to the mounting block 26 reaching its uppermost and lowermost positions, respectively.

The gear block 38 is mounted between, and vertically supported by, a pair of opposed fixed position, upper and lower compression springs 40-1, 40-2. More specifically, the upper compression spring 40-1 is mounted between the gear block 38 and a bolt member 41 threadably coupled to support flange 28-1 of the upright support 28, while the lower spring 40-2 is mounted between the gear block 38 and the base 28-2 of the upright support 28. Turning adjustments applied to the bolt 41 will thus translate in adjustments to the bias force exerted by the springs 40-1, 40-2.

The gear block 38 rigidly carries a vertically oriented control rod 42 having a pair of horizontally oriented stops 42-1, 42-2 at each end thereof. The control rod 42 is, in turn, slidably coupled to the mounting block 26. Just prior to reaching its uppermost and lowermost positions, however, the mounting block 26 will come into contact with the upper and lower stops 42-1, 42-2, respectively of the control rod 42.

Just prior to the mounting block 26 reaching its uppermost and lower most extents, the pinion gears 36-1, 36-2 will be prevented from further rotating along their respective gear rack 38-1, 38-2 by virtue of the contact established between the mounting block 26 and the upper and lower stops 42-1, 42-2. Thus, as the mounting block 26, and the transfer arms 32-1, 32-2 carried thereby, are driven to their uppermost and lowermost positions, the mounting block 26 will be essentially locked as a unit with the gear block 38 causing it to move against the bias force of the upper and lower springs 40-1, 4-2. The net effect of this movement is that during the final extents of the mounting block's 26 vertical displacement, the pick-up heads 32-3, 32-4 will be locked in their full vertically upward and downward orientations, respectively.

A pair of guide arms 30-1, 30-2 are provided which include eyelet flanges 30-3, 30-4, respectively, so as to support the pneumatic conduits PC-3 and to ensure that such conduits PC-3 remain clear of the movable structures described previously during lid transfer and reorientation operations.

Figure 5A:
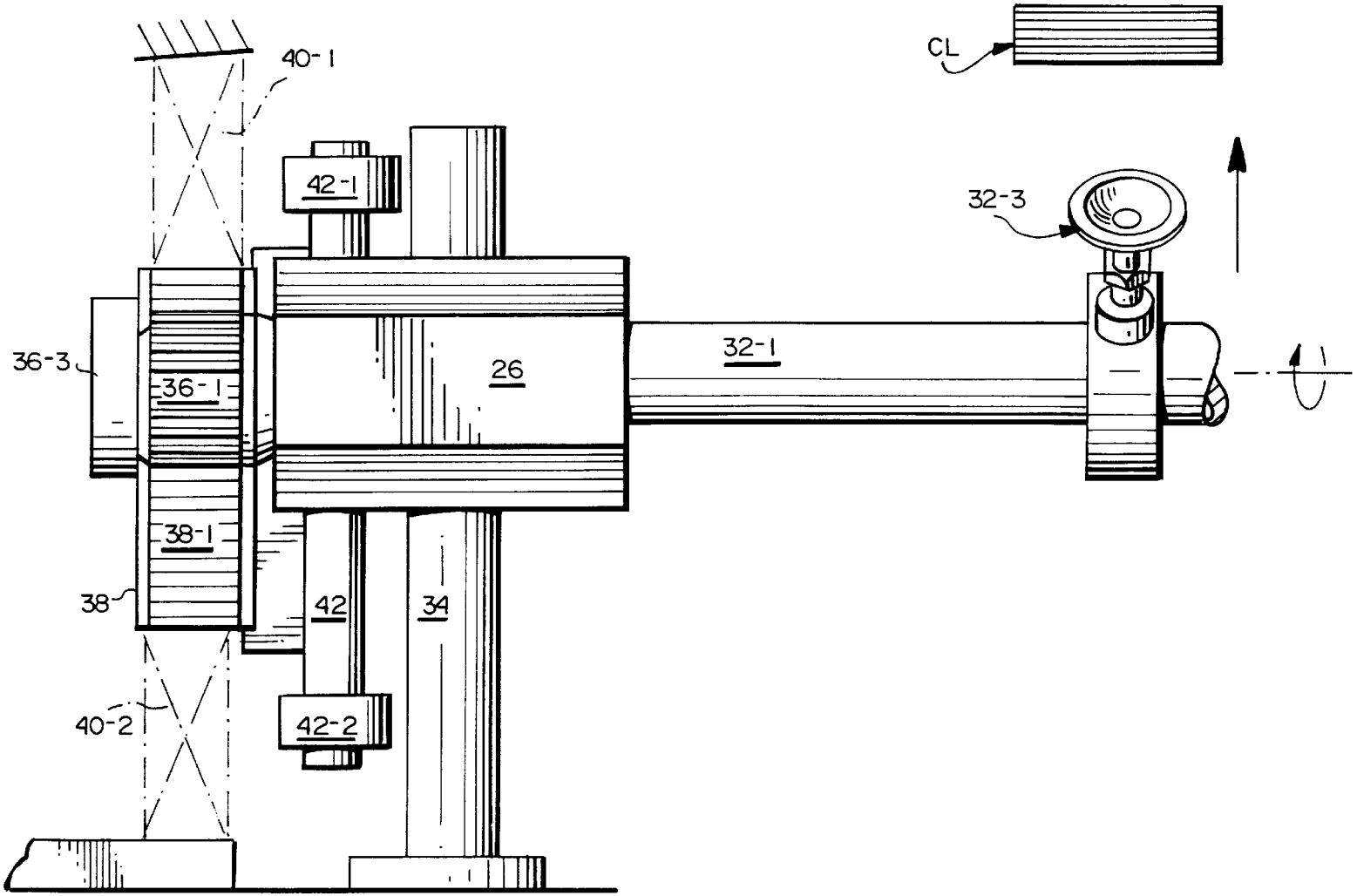
FIGS. 5A–5F schematically depict an operational sequence in accordance with the lid transfer and positioning system of this invention.

In use therefore, with reference to FIGS. 5A–5F, as the mounting block 26 is driven upward by the drive shaft 34, the pinion gears 36-1, 36-2 are caused to rotate by virtue of their intermeshed connection with the gear racks 38-1, 38-2, respectively. Rotation of the pinion gears 36-1, 36-2 will, in turn, cause the transfer arms 32-1, 32-2 and the pick-up heads 32-3, 32-4 carried thereby to rotate in respective clockwise and counterclockwise directions (as viewed in FIG. 3). Such a state is depicted in FIG. 5A.

Figure 5B:
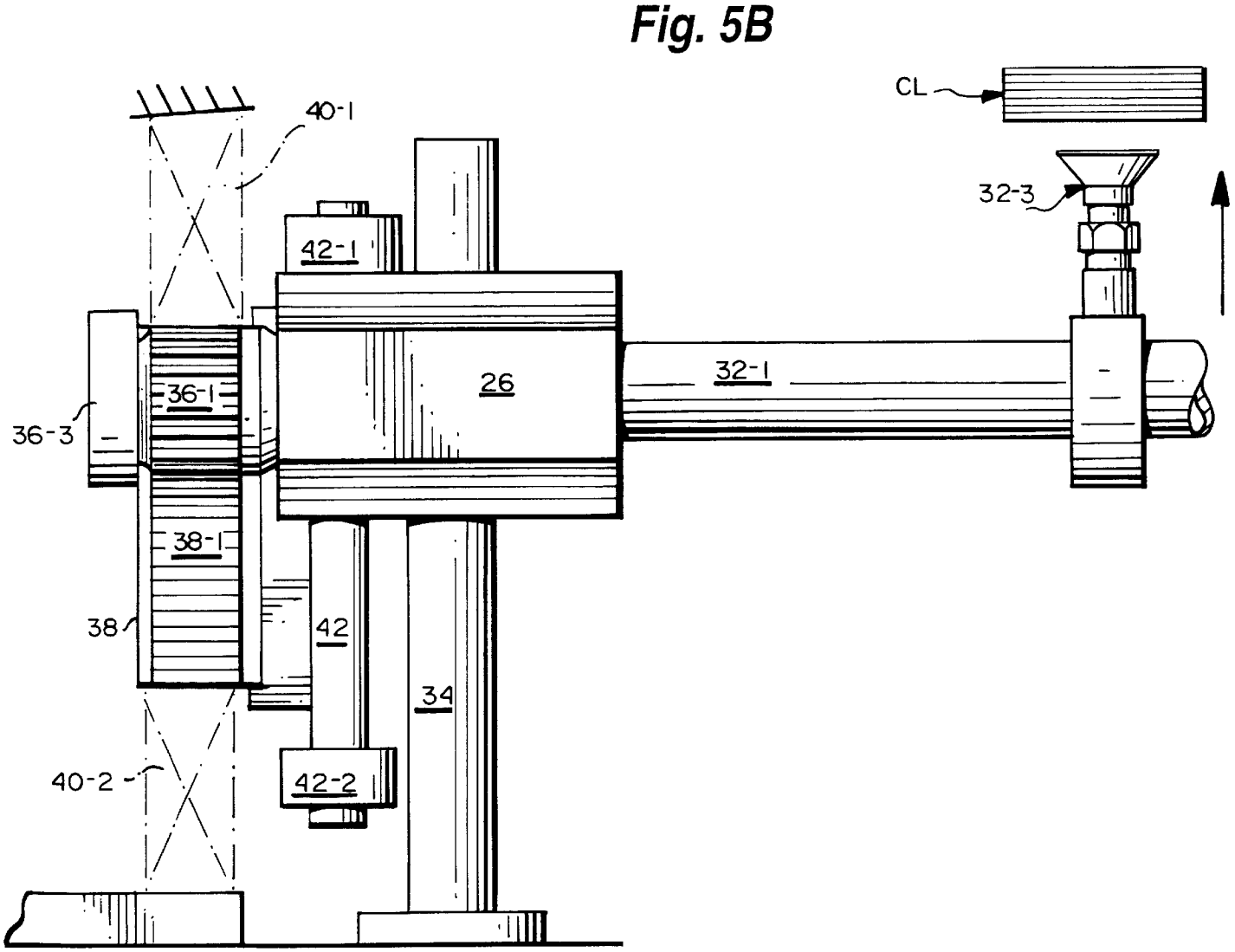
Figure 5C:
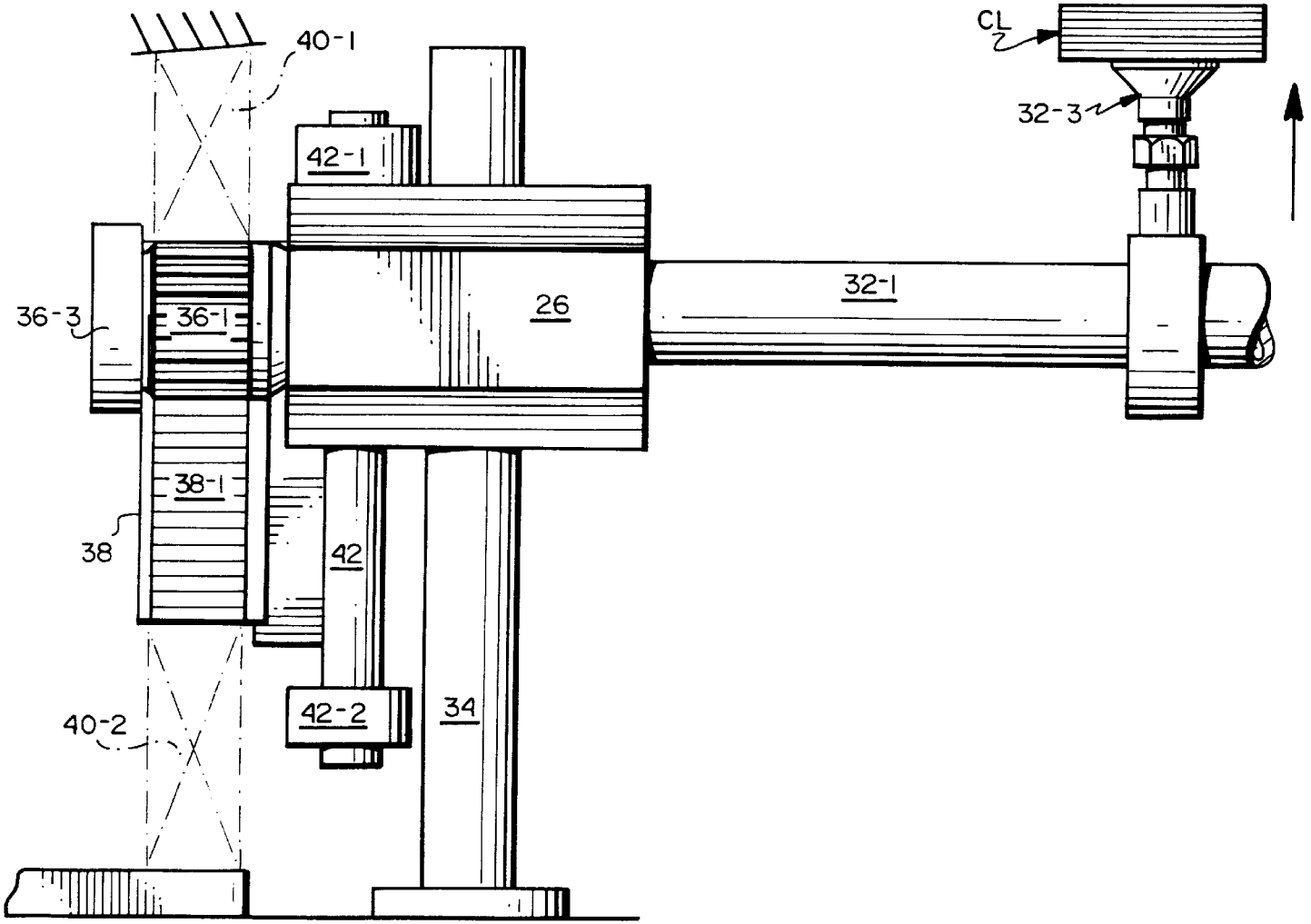

As shown in FIG. 5B, upon the vacuum heads 32-3, 324 reaching their full vertically upward orientation, the mounting block 26 will have come into contact with the upper stop 42-2 of the control rod 42. Contact between the upper stop 42-2 and the mounting block 26 will therefore essentially mechanically lock the mounting block 26 to the gear block 38 such that continued upward vertical displacement of the mounting block 26 will be against the bias force of the upper spring 40-1. Therefore, the pick-up heads 32-3, 32-4 will remain in their full vertically upward orientation as they are vertically displaced the remaining small distance into contact with a lowermost one of the container lids CL in the stack thereof. Such a state is shown in FIG. 5C.

At this time, conventional timing devices will actuate solenoid valves causing the transfer heads to be connected to a source of vacuum (not shown) causing the lowermost one of the container lids CL to be captured by the transfer heads. The magazines 22-2 are each provided with a mechanical detent member (not shown which fractionally retains the container lids in the stack. However, upon being captured by the vacuum transfer heads, the lowermost lid CL in the stack within the magazines 22-2 will be forcibly pulled past the detent member. The pneumatic conduits PC-3 connected to the release collars 22-3 of magazines 22-2 provide air separation between lids CL making sequential separation more reliable and easy. In such a manner, therefore, the lowermost lid CL in the stack within the magazine 22-2 will be released and will be held under the influence of vacuum by the pick-up heads 32-3, 32-4.

Figure 5D:
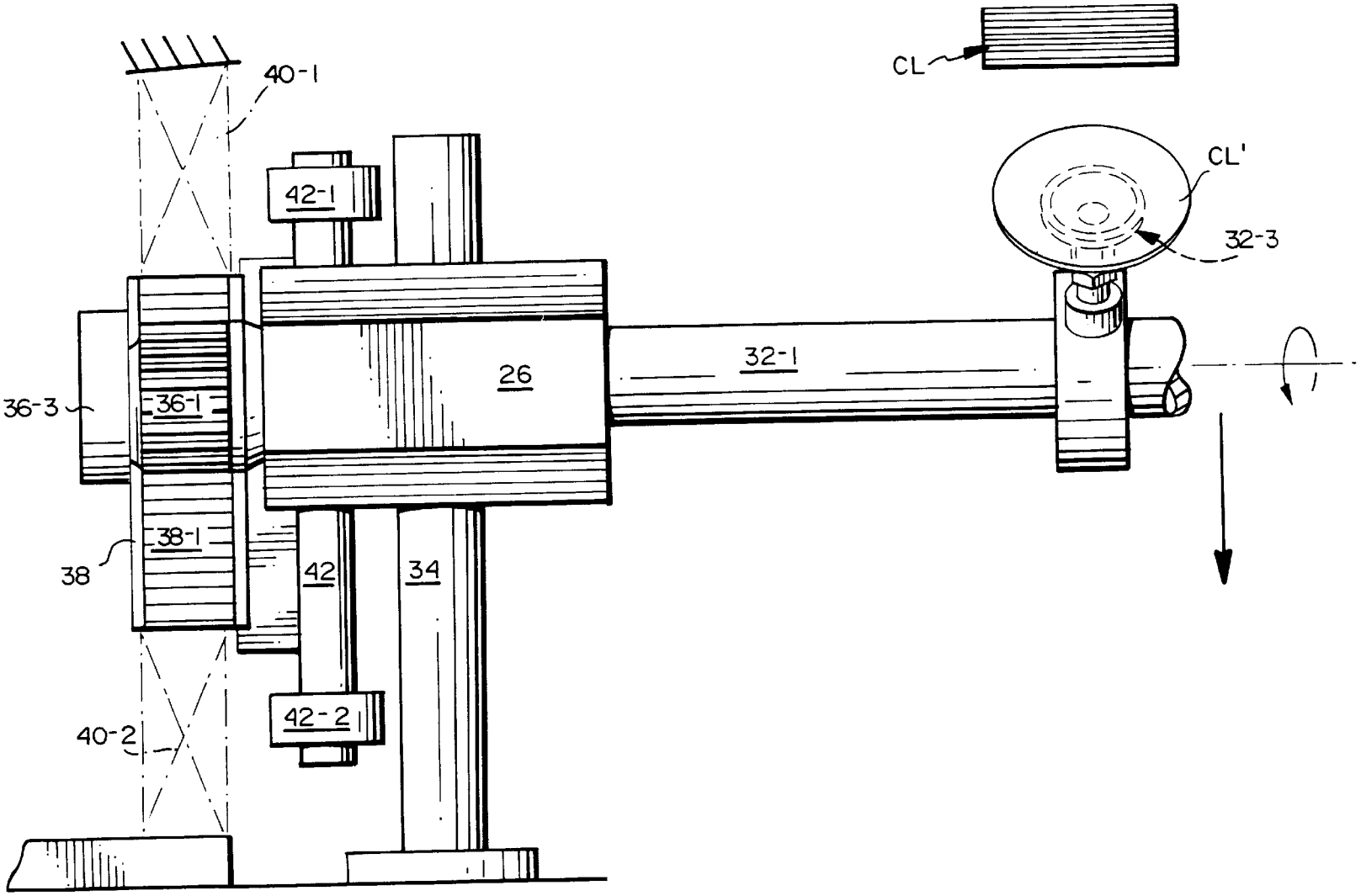

Just after the drive shaft 34 reverses its stroke and begins its downward travel, the bias force of the upper spring 40-1 will urge the gear block 38, and thus the upper stop 42-1, downwardly thereby causing the upper stop 42-1 to remain engaged with the mounting block 26. However, when the drive shaft 34 has moved the mounting block 26 sufficiently downward to an extent that the upper spring 40-1 returns to its normal (uncompressed) state, the gear block 38 and the control rod 42 rigidly connected thereto will remain stationary while the mounting block 26 continues its downward travel. As a result, the mounting block 26 will separate from the upper stop 42-1 of the control rod 42 thereby causing the pinion gears 36-1, 36-2 to rotate in counterclockwise and clockwise directions, respectively, as viewed in FIG. 3 (i.e., in opposite directions to that described above). The transfer arms 32-1, 32-2 and their respective pick-up heads 32-3, 32-4 will thus be rotated similarly carrying the lowermost container lid (designated CL') picked up from the magazine stack therewith. This state of the operational cycle is depicted in FIG. 5D.

Figure 5E:
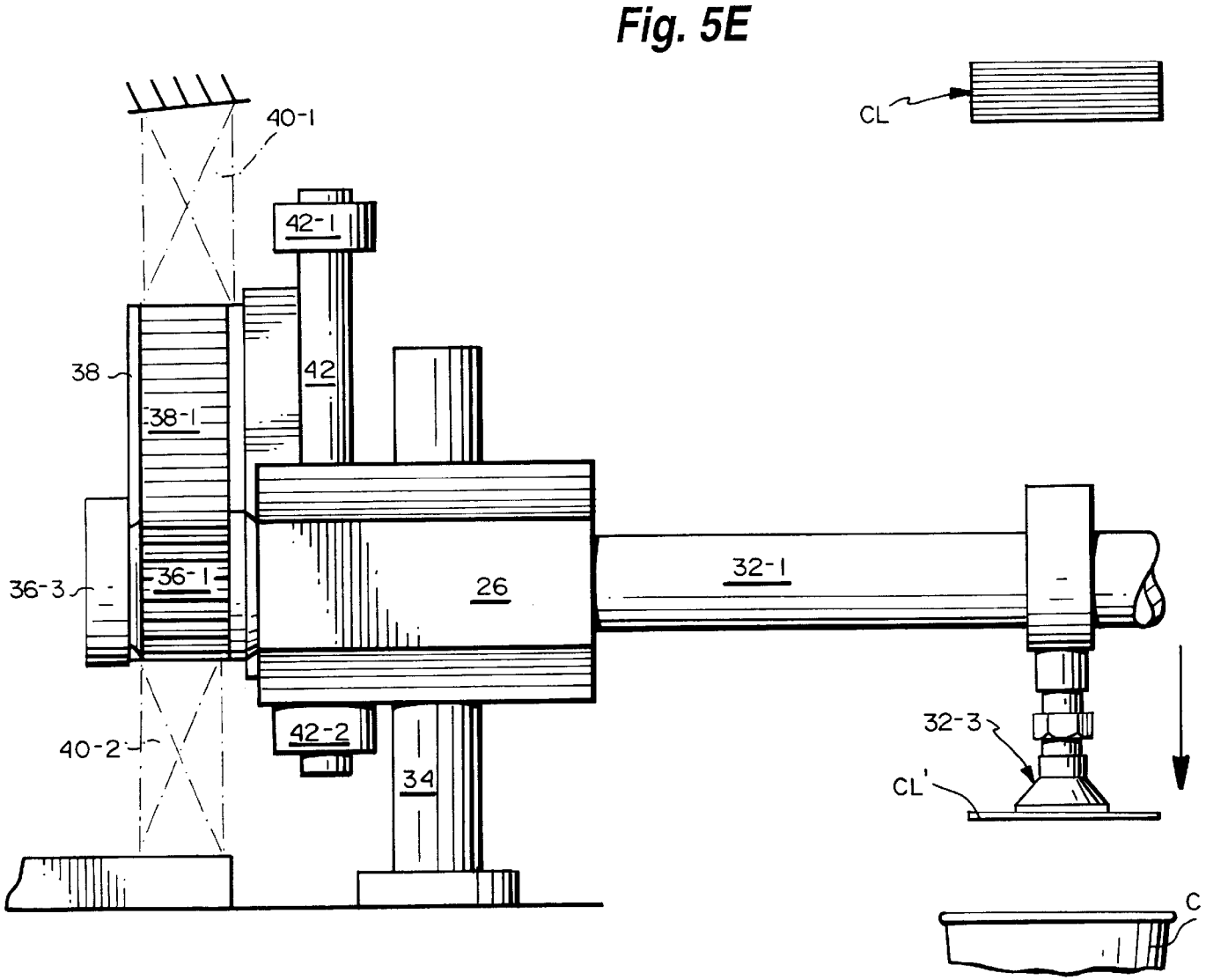
Figure 5F:
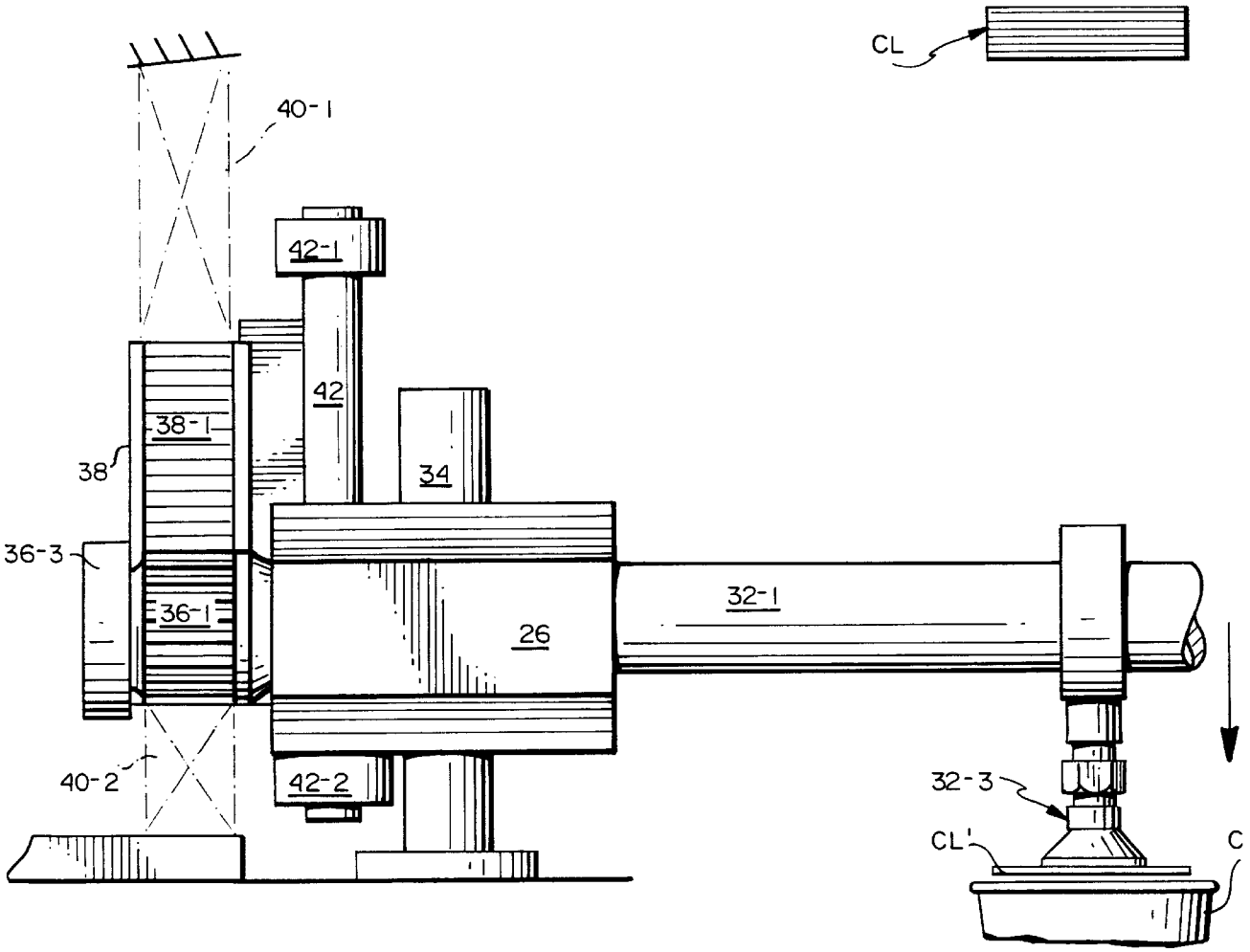

The mounting block 26 will ultimately come into contact with the lower stop 40-2 during its downward movement as shown in FIG. 5E. At that time, the pick-up heads 32-3, 32-4 will be in their full vertically downward orientation so that the container lid CL' carried thereby is substantially horizontally disposed over, but spaced above an awaiting frozen dessert cone C. Contact between the lower stop 42-2 and the mounting block 26 will thus mechanically lock the mounting block to the gear block 38 so as to keep the pick-up heads 32-3, 32-4 in their full vertically downward orientation during the final moments of the downward stroke to thereby seat the lid CL' onto the awaiting cone C as shown in FIG. 5F. Such continued downward displacement of the mounting block will compress the lower spring 40-2 so that, upon stroke reversal, the lower stop 42-2 will remain in contact with the mounting block 26 until such time that it has traveled upwardly a sufficient distance to cause the lower spring 40-2 to once again assume its normal (uncompressed) state. At that time, the cycle will repeat itself as described previously starting with FIG. 5A.

The present invention thus provides a lidding system 20 which is connectable to a reciprocal drive assembly which is driven at a substantially constant reciprocating speed. Moreover, the lidding system 20 of the present invention mechanically controls rotation the orientation of the pick-up heads so that they remain in their vertically upward and downward orientations during the final moments of the upward and downward drive strokes.

Therefore, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A container lidding system comprising:

a mounting block having uppermost and lowermost displacement positions;

a transfer arm rotatably carried by the mounting block;

a lid pick-up head carried by the transfer arm and adapted to pick up a container lid from a supply thereof and transfer the container lid to an awaiting container, said pick-up head being rotatable as a unit with said transfer arm between upward and downward orientations;

a drive assembly connected to said mounting block for causing mounting block displacement at a substantially constant displacement rate between said uppermost and lowermost positions thereof during upward and downward strokes thereof; and a mechanical control assembly which includes:

(a) a control rod rigidly attached to a gear rack and slidably received by said mounting block, said control rod having upper and lower stops which contact said mounting block during displacements thereof between said uppermost and lowermost positions and thereby establish said upward and downward orientations of said pick-up head, (b) a pair of opposed springs, (c) said gear rack mounted between and supported by said opposed springs, and (d) a pinion gear attached to said transfer arm and intermeshed with said gear rack, wherein said gear rack remains stationary while said pinion gear rotates in intermeshed relationship therewith during a major extent of said mounting block displacement between said uppermost and lowermost displacement positions thereof to cause said transfer arm responsively to rotate and allow said pick-up head to assume said upward and downward orientations during upward and downward strokes, respectively, of said drive assembly, and wherein said gear rack is mechanically locked to, and movable as a unit with, said mounting block against bias force of the springs during final travel of said mounting block to said uppermost and lowermost displacement positions by virtue of said mounting block contacting said upper and lower stops during said upward and downward strokes, respectively, of said drive assembly to thereby maintain said upward and downward orientations of said pick-up head throughout said final travel of said mounting block.

2. The system of claim 1, further comprising a magazine adjacent said uppermost position of said mounting block for accommodating a stack of container lids.

3. The system of claim 1, comprising a pair of said transfer arms each having a plurality of said pick-up heads.

4. The system of claim 3, wherein said mechanical control assembly includes a gear block having a pair of said gear racks, and a pair of said pinion gears intermeshed with a respective one of said gear racks.

5. The system of claims 1 or 3, wherein said pick-up heads are connectable to a source of vacuum.

* * * * *